US006474387B1

(12) United States Patent
Shimao

(10) Patent No.: US 6,474,387 B1
(45) Date of Patent: Nov. 5, 2002

(54) SORTING DEVICE

(75) Inventor: Tetsuro Shimao, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/520,362

(22) Filed: Mar. 7, 2000

(30) Foreign Application Priority Data

Mar. 9, 1999 (JP) ..... 11-061257

(51) Int. Cl.[7] ..... B07C 5/02

(52) U.S. Cl. ..... 156/364; 156/542; 156/521; 399/401; 271/291; 209/3.3

(58) Field of Search ..... 156/362, 363, 156/364, 541, 542, 556, 558, 566, 521, DIG. 2, DIG. 27, 517, 265; 399/401, 403, 404; 271/291, 298, 303; 209/313

(56) References Cited

U.S. PATENT DOCUMENTS 3,245,859 A * 4/1966 Busk ..... 156/479
4,966,644 A * 10/1990 Clark, Jr. et al. ..... 156/247
5,086,320 A * 2/1992 Koike ..... 355/318
5,842,577 A * 12/1998 Stevens et al. ..... 209/3.3
6,206,369 B1 * 3/2001 Hoshii ..... 271/291

* cited by examiner

*Primary Examiner*—Richard Crispino
*Assistant Examiner*—Yewebdar T Tadesse
(74) *Attorney, Agent, or Firm*—Foley & Lardner

(57) ABSTRACT

A sorting device for reversing a sheet fed from a printer and adhering the tag on the sheet, which includes rollers for conveying the sheet in a forward or backward direction, a sensor for detecting a position of the sheet conveyed by the rollers, a flapper for switching a path conveying the sheet based on a result of the detection by the sensor, and a tag affixing unit for passing the sheet when it is reversed and affixing the tag to the sheet when it is ejected, whereby the sheet may be reversed to be affixed by the tag, and easily and precisely sorted in reference to the affixed tag.

7 Claims, 10 Drawing Sheets

Tag Affixing Unit 16

SORTING DEVICE

BACKGROUND OF THE INVENTION

1. Field of the Invention

This invention relates to a sorting device, and, more particularly, to an improved sorting device coupled with an image forming apparatus which reverses a sheet image formed by the image forming apparatus and affixes a tag to the sheet image formed on its both sides.

2. Description of the Related Art

Conventionally, when an image forming apparatus such as a facsimile machine, a printer, a copy machine and so forth prints both surfaces of a sheet to make a document, one surface is printed first. The sheet is reversed and fed back to the image forming apparatus to print the second surface. After printing on the second surface, the sheet is ejected and stacked on a tray as a document. When a sheet group is taken out after completion of one document, there isn't any inconvenience. When plural documents are sequentially ejected and stacked on one tray, it is convenient that they are sorted and ejected for each document. This is because a position for sectioning each document may be found when they are taken out.

There is well known a sorting device showing such a sectioning position provided with an offset function, in which ejecting positions of sheets are shifted for each document. A position for each sheet group providing the same document is shifted little by little, whereby the portion of such shifted position may indicate a section of the document.

Another conventional sorting device is provided with a function for inserting a ribbon between documents by putting the ribbon on a sheet ejected on a tray and subsequently ejecting a subsequent sheet on that sheet. However, the ejecting operation to the tray is halted when the ribbon is fed, resulting in the necessity of an operation time period for inserting the ribbon and the deterioration of its productivity. The ribbon is simply caught between the documents, and liable to slip off when the sheet group is taken out from the tray, so that the sorting position becomes lost.

Still another conventional sorting device is provided with a plurality of trays in which a tray to be ejected is changed for each document, resulting in bulkiness and costliness of the device, and difficulty of installing the device into a small machine.

The above-mentioned same problems are also found in a conventional document read apparatus when it ejects subsequently read sheets.

Thus the conventional sorting device, which reverses a sheet printed on one surface thereof, again feeds the sheet to the image forming apparatus to print both surfaces of the sheet, and sorts the sheet printed on both surfaces thereof, has the disadvantages that it has a low productivity or is bulky and costly, or precise sorting cannot be expected.

SUMMARY OF THE INVENTION

It is, therefore, a primary object of this invention to provide a sorting device with a simple and small construction which reverses a sheet, affixes a tag to the sheet printed on both surfaces of thereof, and easily and precisely sorts the sheet in reference to the tag.

According to this invention, there is provided a sorting device with a simple and small construction for reversing a sheet fed from an image forming device and adhering a tag to the sheet, which includes a conveyor for conveying the sheet in a first or second direction, a detector for detecting a position of the sheet conveyed by the conveyor, a switch for switching a path conveying said sheet based on a result of the detection by the detecting means, and a tag affixing device for passing the sheet when it is reversed and affixing a tag to the sheet when it is ejected, whereby the sheet is reversed, the sheet printed on both surfaces thereof is affixed by the tag, and the sheet may be easily and precisely sorted in reference to the tag.

BRIEF DESCRIPTION OF THE DRAWINGS

Other objectives and advantages of this invention will be more readily apparent from the following detailed description provided in conjunction with the following figures, of which.

DETAILED DESCRIPTION OF THE PREFERRED EMBODIMENT

Japanese Application JP 61257/1999, filed on Mar. 9, 1999, is hereby incorporated in its entirety by reference into this specification.

Figure 1:
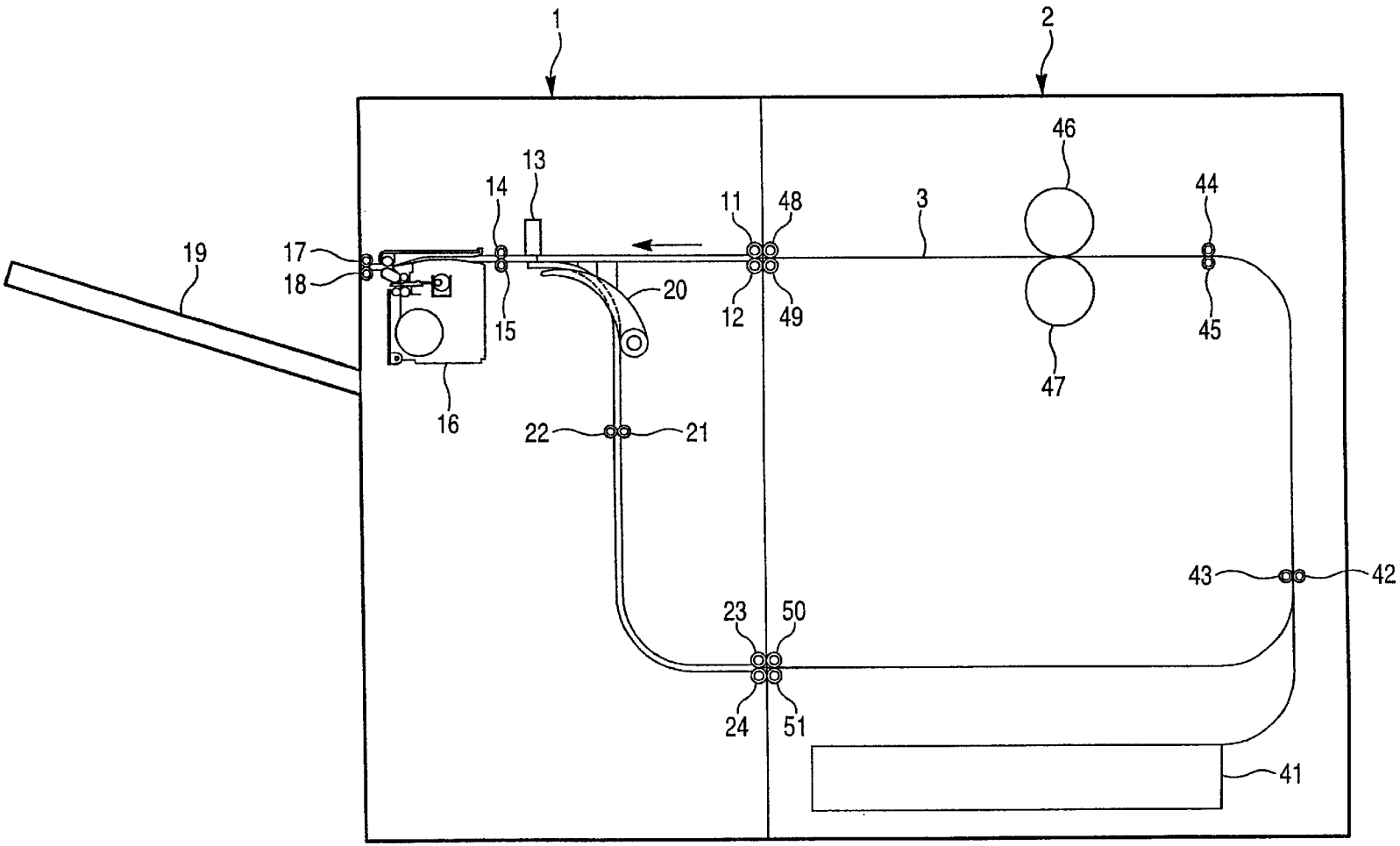
FIG. 1 is a front schematic sectional view of a sheet sorting device according to a preferred embodiment of this invention.
Figure 2:
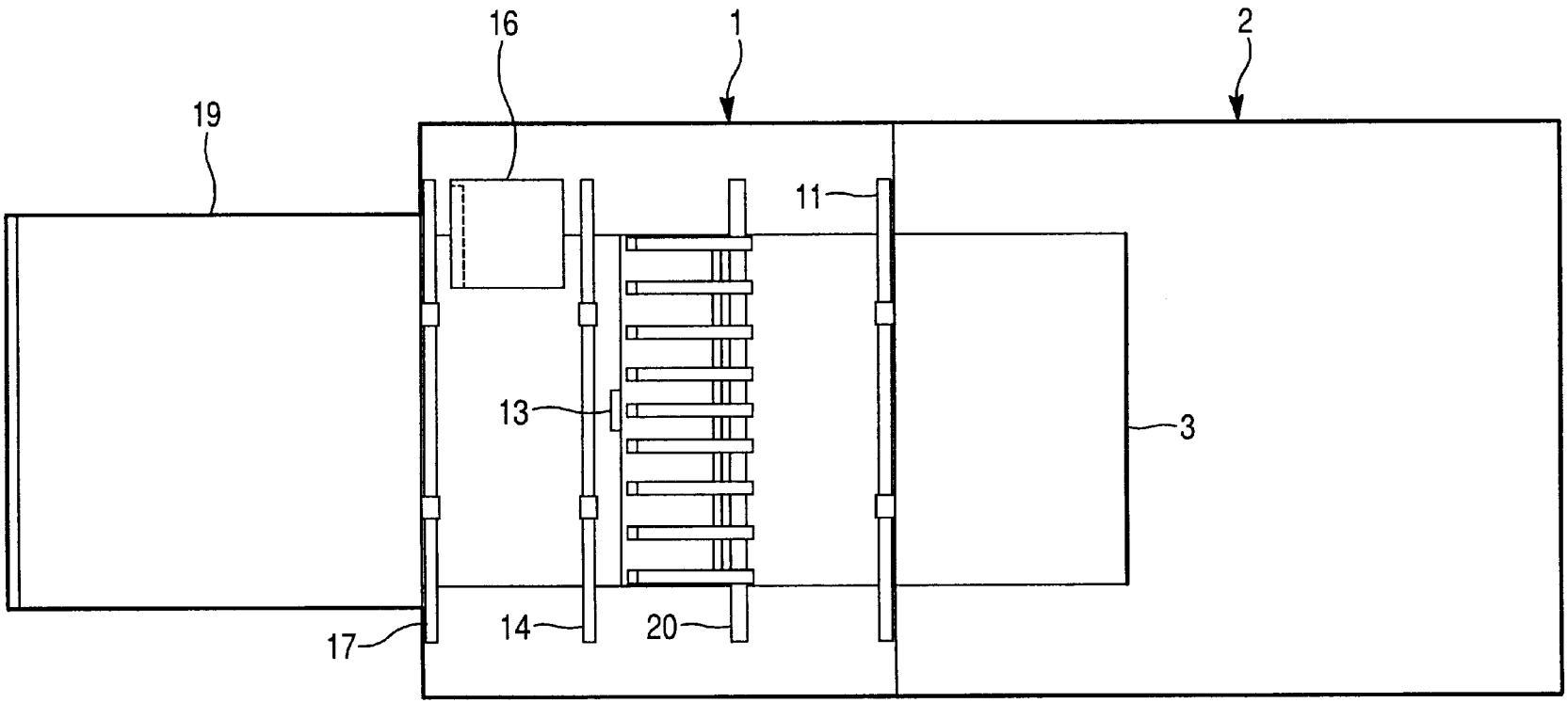
FIG. 2 is a top schematic view of the sheet sorting device of FIG. 1.

Referring, now, to FIG. 1, there is shown a schematic front view of a sheet sorting device 1 coupled with a printer 2 as a preferred embodiment of this invention. FIG. 2 shows a top plan view of the same. The printer 2 conveys a sheet 3 stored in a tray 41 by rollers 42 and 43 and rollers 44 and 45 to be fed to an exposure drum 46 and a roller 47. The exposure drum 46 catches the sheet 3 with the roller 47 for conveyance to transcribe an image formed on the drum to an upper surface of the sheet 3 in FIG. 1, whereby the transcribed sheet 3 is caught by rollers 48 and 49 to be fed to the sheet sorting device 1.

Rollers 11 and 12 catch and convey the sheet 3 fed from the printer 2 to flapper 20 which is biased by a spring (not shown in drawings) so as to swing counter-clockwise and driven by a solenoid (not shown in drawings) so as to swing clockwise. When the solenoid is OFF (not actuated), the flapper 20 swings counter-clockwise by the spring to come into contact with a predetermined position of the sheet sorting device 1 (hereinafter referred to "the flapper 20 is closed"). As the flapper 20 is closed, the sheet 3 conveyed to the rollers 11 and 12 is fed to the rollers 14 and 15.

A sensor 13 represented by a limit switch or a reflection-type photoelectric switch or other convenient implementation, generates a predetermined signal to be applied to a controller (not shown in drawings) when the sheet 3 is located at the sensor 13 (hereinafter expressed as "the sensor 13 is ON"). When the sheet 3 does not exist in the path sensed by the sensor 13, another signal is generated to be applied to the controller (hereinafter expressed as "the sensor is OFF").

When the sheet 3 is fed from the rollers 11 and 12 through the closed flapper 20, the rollers 14 and 15 catch and rotate the sheet 3 in a predetermined direction to be conveyed to rollers 17 and 18 through a tag affixing unit 16. The rollers 17 and 18 together with the rollers 14 and 15 catch and rotate the sheet 3 in a predetermined direction so as to convey the sheet 3 toward the left-hand side in FIGS. 3 and 4 until a predetermined position when the sensor 13 turns OFF and stop.

Figure 3:
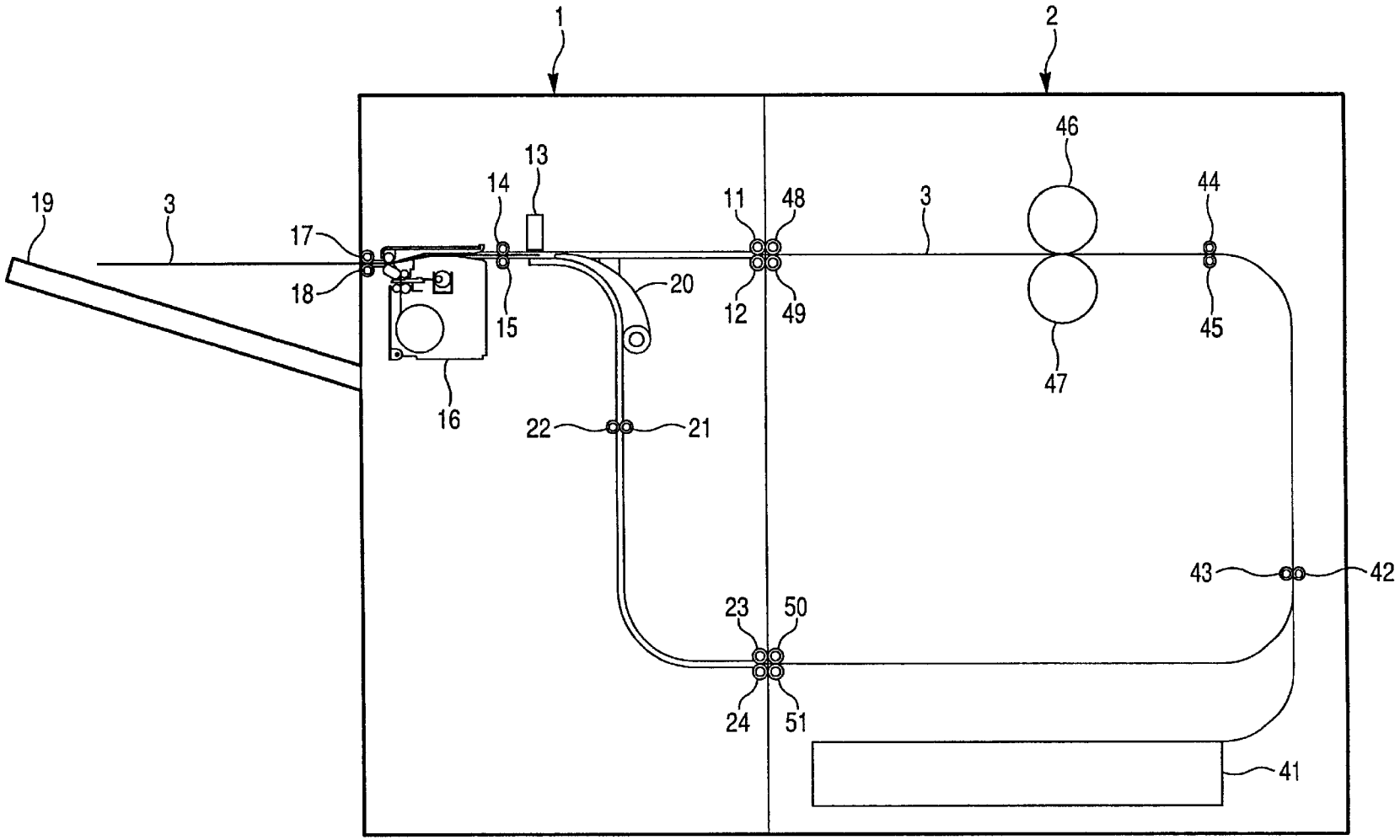
FIG. 3 is a front schematic sectional view of the sheet sorting device when it reverses a sheet.
Figure 4:
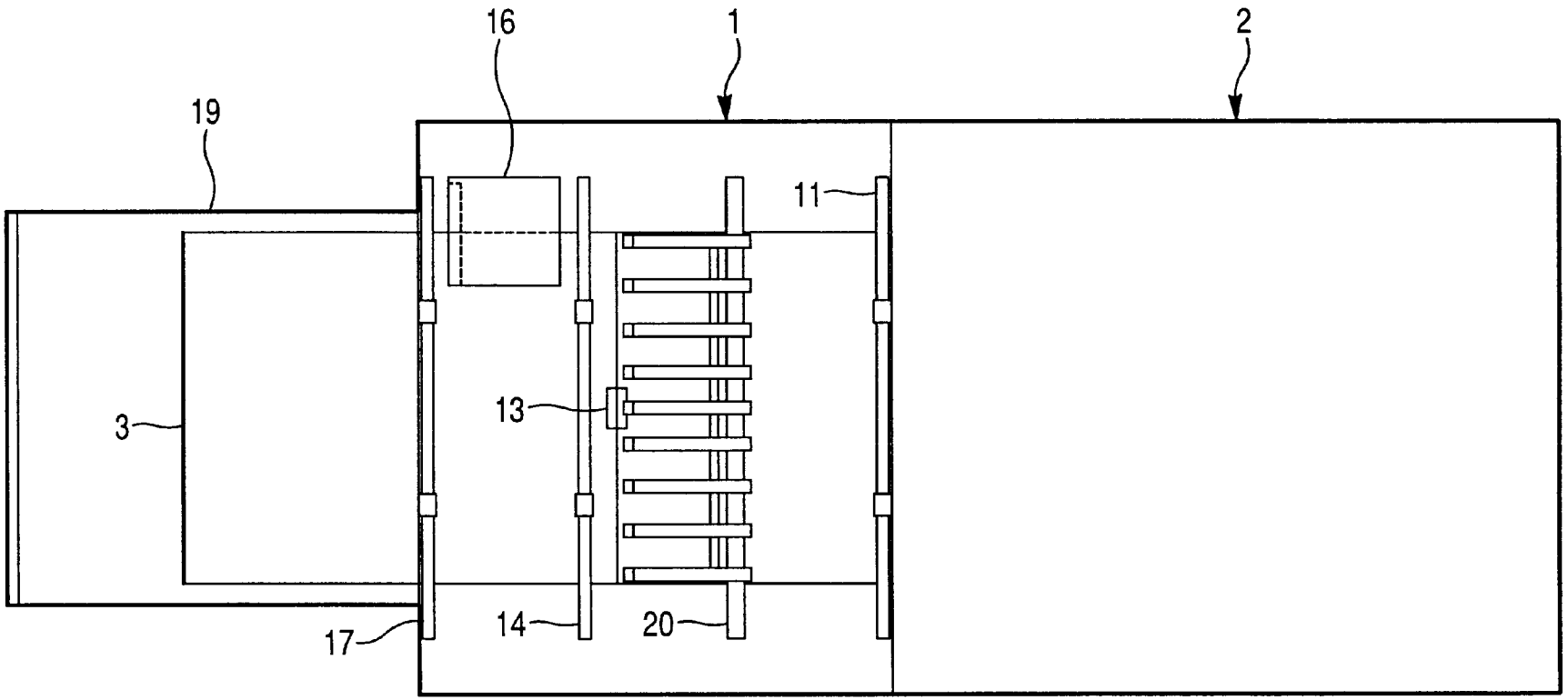
FIG. 4 is a front schematic view of the sheet sorting device when it reverses the sheet.

In FIGS. 3 and 4, as the sheet 3 is conveyed by the rollers 14 and 15 and the rollers 17 and 18, the sensor 13 is turned ON and, after that, turned OFF, whereby the solenoid (not shown) is turned ON by the controller (not shown). As the solenoid is turned ON, the flapper 20 is swung clockwise by the solenoid to come into contact with the predetermined position of the sheet sorting device 1 (hereinafter expressed as "the flapper is open").

After the flapper 20 is opened, the rollers 14 and 15 and the rollers 17 and 18 rotate in a direction opposite to their original rotation direction, and the sheet 3 is conveyed to a path viewed by rollers 21 and 22.

When the sheet 3 printed on one surface thereof is conveyed through the tag affixing unit 16 by the rollers 14 and 15 and the rollers 17 and 18, the tag affixing unit 16 stops its operation and does not hinder the conveyance of the sheet 3.

The rollers 21 and 22 catch the sheet 3 fed from the rollers 14 and 15 via the opened flapper 20 and rotate the same in a predetermined direction to be conveyed to the rollers 23 and 24. The rollers 23 and 24 catch and rotate in a predetermined direction the sheet 3 fed from the rollers 21 and 22 to be fed to rollers 50 and 51 of the printer 2.

The printer 2 conveys the sheet fed from the sheet sorting device 1 by the rollers 42 and 43 and the roller 44 and 45 to be fed to the exposure drum 46 and the roller 47. The exposure drum 46 together with the roller 47 catches and conveys the sheet 3, and transcribes an image formed on a surface of the drum to the upper surface of the sheet 3. The sheet 3 on both surfaces of which images are formed is caught by the rollers 48 and 49, and again fed to the sheet sorting device 1.

Figure 5:
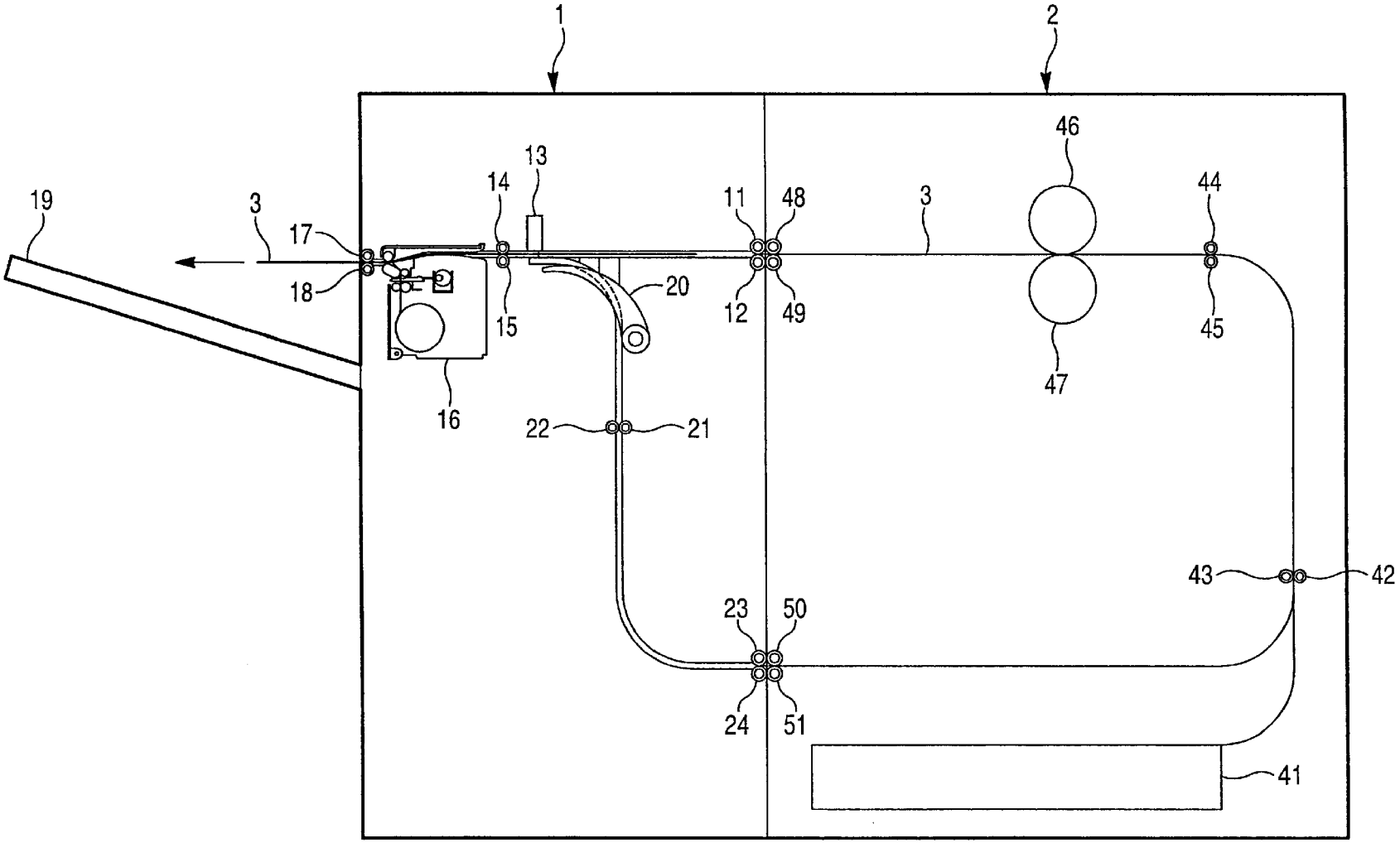
FIG. 5 is a front schematic sectional view of the sheet sorting device when a tag is affixed to a sheet.

The rollers 11 and 12 of the sheet sorting device 1 catch the sheet 3 fed from the printer 2, and conveys the same to the rollers 14 and 15 through the closed flapper 20. As shown in FIG. 5, the rollers 14 and 15 catch and rotate in the predetermined direction the sheet 3 to be conveyed to the rollers 17 and 18 through the tag affixing unit 16.

As the sheet 3 printed on both surfaces thereof is fed to the sheet sorting device 1, the tag affixing unit 16 starts its operation in a predetermined time, which is determined by a distance "a" between the sensor 13 and a predetermined position of the tag affixing unit 16, a predetermined distance "b" from a side of the sheet 3, and a conveyance speed of the sheet 3, wherein the tag affixing unit 16 affixes a tag 4 having a predetermined width to a predetermined position of the sheet 3 printed on both surfaces of the sheet.

As the time from the turning ON by the sensor 13 to the initiation of the operation by the tag affixing unit 16 is changed, the position, the predetermined distance "b" from a side of the sheet 3, where the sheet 3 is affixed by the tag 4 is also changed. The rollers 17 and 18 rotate in a predetermined direction to eject the sheet 3 affixed by the tag 4 on a tray 19.

Figure 7:
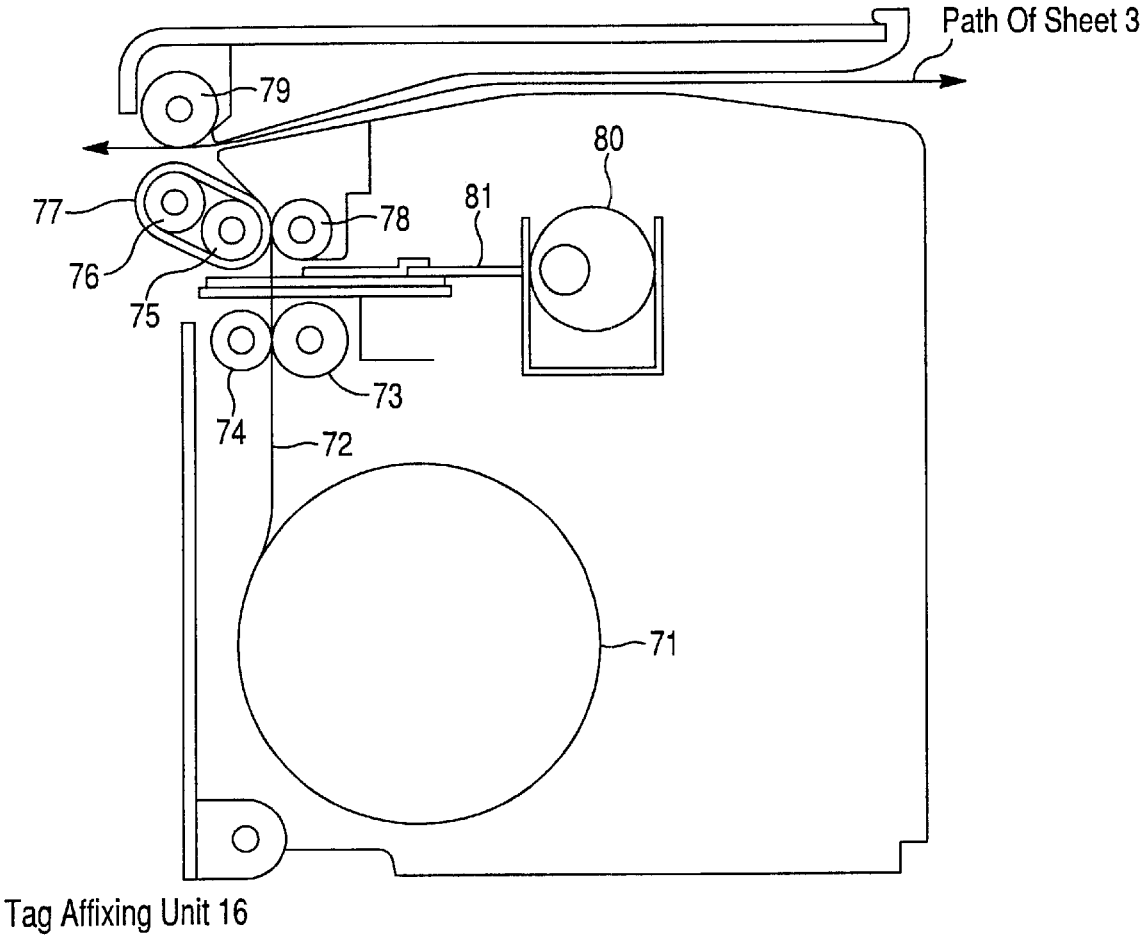
FIG. 7 is a schematic view of a tag affixing unit employed in the sheet sorting device wherein a tag affixing belt is located at a lower position.

Next, the tag affixing unit 16 will be described in detail hereinafter. FIG. 7 shows a construction of the tag affixing unit 16 which supports a tape roll 71 for a rotary movement within the unit. The tape roll 71 is a wound paper belt tape 72, a predetermined edge of which is applied by pressure sensitive adhesive. A pair of pull-out rollers 73 and 74 guides the belt tape 72 continuously to pull out tape from the tape roll 71 to a predetermined position.

Figure 8:
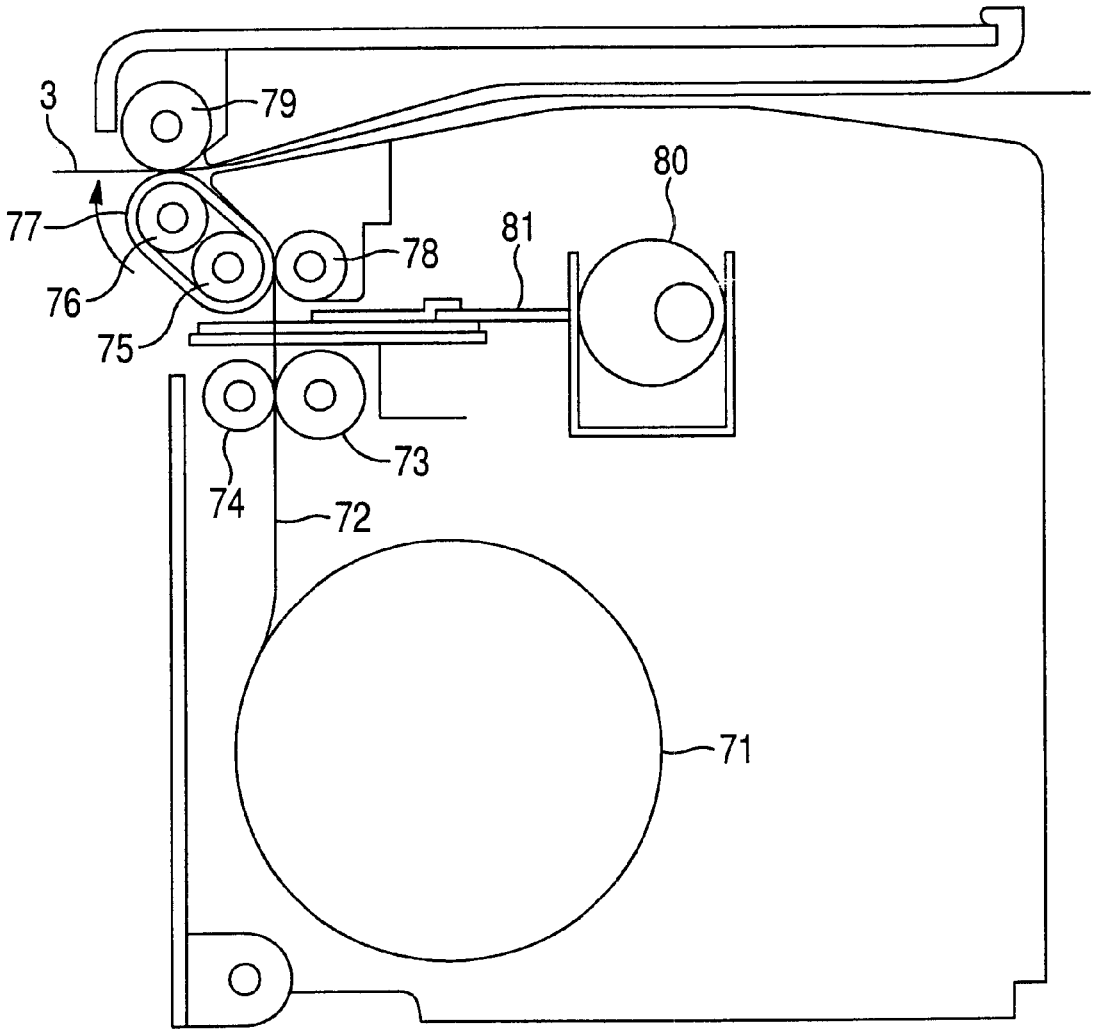
FIG. 8 is a schematic view of the tag affixing unit wherein the tag affixing belt is located at an upper position.

A cut unit 81 is disposed above the pull-out rollers 73 and 74, and cuts the pull out belt tape 72 by a predetermined length as an upper blade moves forward, thereby producing the tag 4. The tags 4 separated one by one from a tip of the belt tape 72 are brought to a guide roller 78 and a tag affixing belt 77 to be guided to the predetermined position on a side edge of the sheet 3 for contact therewith. The tag affixing belt 77 is wound back between a drive belt pulley 75 and a passive belt pulley 76, and swung clockwise or counter-clockwise within a predetermined angle at the center of the drive belt pulley 75. In FIG. 8, as the passivity belt pulley 76 swings clockwise, a tag affixing belt 77 comes into contact with a conveyance roller 79 to catch and push by a predetermined pressure the sheet 3 and the tag 4 between the rollers 77 and 79 to be conveyed. Thus, an adhesive portion of the tag 4 is press-contacted with the sheet 3, thereby affixing the tag 4 onto the sheet 3.

The revolution speed of the tag affixing belt 77 is designed to be equal to that of the conveyance roller 79, synchronizing the conveyance speed of the sheet 3. Accordingly, the tag 4 may be affixed to the sheet 3 by a sequential operation without stopping the conveyance operation of the sheet 3. In an initial position, the passivity belt pulley 76 is positioned at the swing position in a counter-clockwise direction (as shown at a lower position in FIG. 7), where the belt 77 and the roller 79 are separated by a predetermined interval and the conveyance of the sheet 3 for a reversal motion is not hindered.

The pull-out roller 73, the cut unit 81, the tag affixing belt 77 and so forth are respectively connected with tuck operation motors and intermittently driven for a rotary movement at a predetermined timing. As the tuck operation motors rotate forward, the drive force by the tuck operation motors are transferred to the pull-out roller 73, the tag affixing belt 77, and the conveyance roller 79, but not transferred to an eccentricity cam 80 driving the cut unit 81. As the tuck operation motors rotate in reverse, the drive force by the tuck operation motors are transferred to the eccentricity cam 80, but not transferred to the pull-out roller 73, the tag affixing belt 77, and the conveyance roller 79.

As the tuck operation motors rotate forward and the cut unit 81 moves to the left-hand side in the drawing of FIG. 8, the tag affixing belt 77, the passivity belt pulley 76 and the drive belt pulley 75 generally rotate clockwise within a predetermined angle at the center of the drive belt pulley 75. As the tuck operation motors rotate in reverse and the cut unit 81 moves to the right-hand side in the drawing of FIG. 7, the tag affixing belt 77, the passivity belt pulley 76 and the drive belt pulley 75 generally rotate counter-clockwise within a predetermined angle at the center of the drive belt pulley 75.

Figure 9:
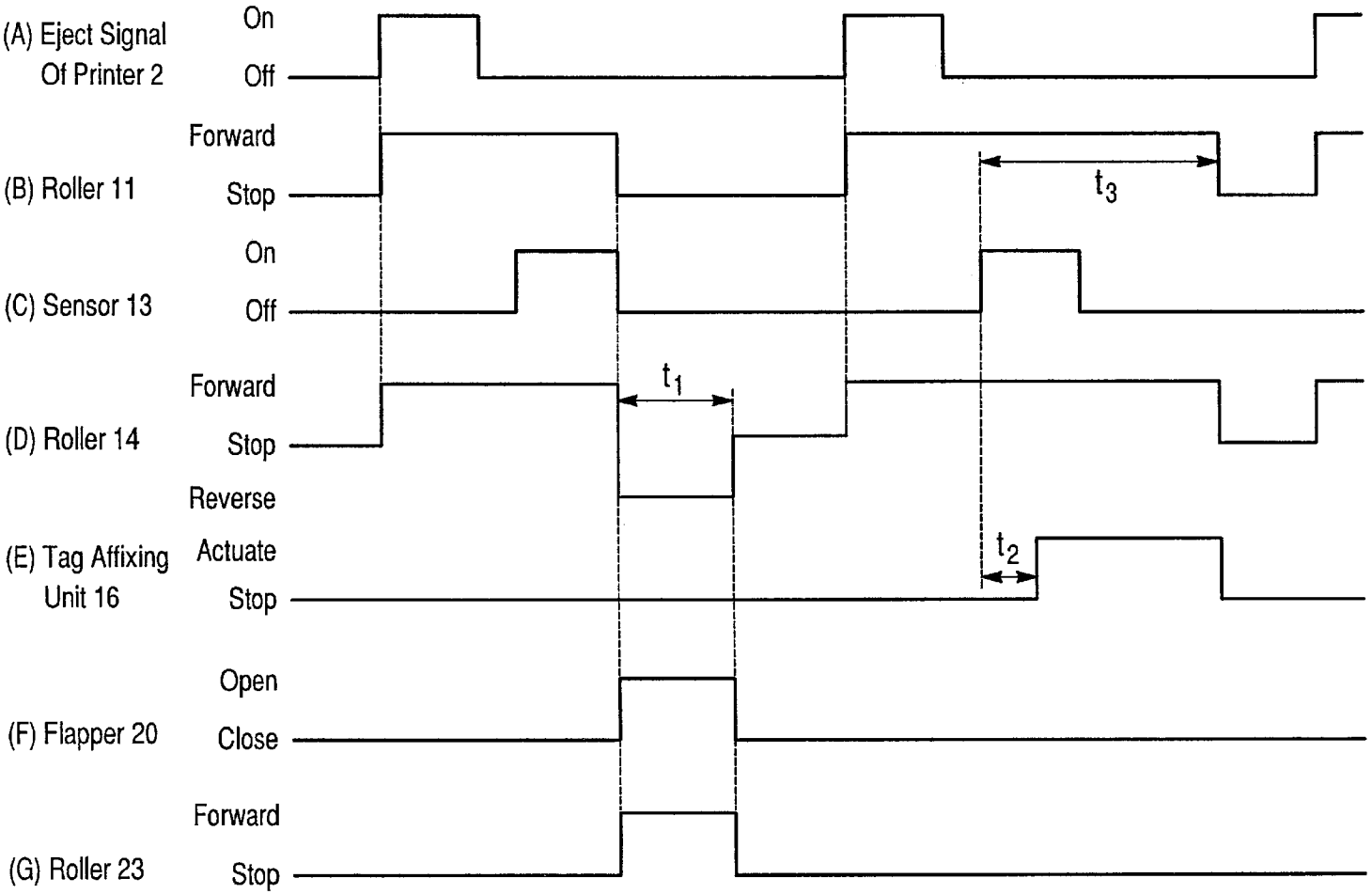
FIG. 9 shows a timing chart to explain a timing of the sheet sorting device.

FIG. 9 shows a timing chart showing the timing of the operation of the sheet sorting device 1. As a sheet eject signal of the printer 2 for ejecting a sheet printed on one surface thereof is turned ON as shown in FIG. 9 at (A), the controller of the sheet sorting device 1 rotates forward the rollers 11 and 12, the rollers 14 and 15, and the rollers 17 and 18 as shown in FIG. 9 at (B) and (D), and closes the flapper 20 during such forward rotary as shown in FIG. 9 at (F).

Then the sheet 3 fed from the printer 2 is withdrawn within the sheet sorting device 1 to be passed in the path of the rollers 11 and 12, the flapper 20, and the rollers 14 and 15, the tag affixing unit 16, and the rollers 17 and 18.

As the sheet 3 conveyed by the rollers 14 and 15 and the rollers 17 and 18 passes the conveyance path set by the sensor 13 and the sensor 13 is turned OFF (the sensor 13 is turned OFF after it is turned ON) as shown in FIG. 3, the controller of the sheet sorting device 1 stops the rollers 11 and 12 and rotates in reverse the rollers 14 and 15 and the rollers 17 and 18 for a predetermined time period t1. As shown in FIG. 9 at (E) and (F), at the same timing for the predetermined time period t1, the controller opens the flapper 20 and rotates forward the rollers 21 and 22 and the rollers 23 and 24. Then the sheet 3 caught by the rollers 14 and 15 and the rollers 17 and 18 is conveyed in the path of the rollers 21 and 22 and the rollers 23 and 24 through the opened flapper 20 to be fed to the printer 2.

During the time when the sheet 3 is reversed, the controller stops the tag affixing unit 16 as shown in FIG. 9 at (E). Accordingly, the tag affixing belt 77 is separated from the conveyance roller 79 by the predetermined interval, and the conveyance of the sheet 3 is not hindered when it is reversed.

When the period t1 elapses, the controller stops the rollers 14 and 15, closes the flapper 20, and stops the rollers 21 and 22 and the rollers 23 and 24.

As the sheet eject signal of the printer 2 is turned ON to eject the sheet 3 printed on both surfaces thereof as shown in FIG. 9 at (A), the controller rotates forward the rollers 11, 12, 14, 15, 17 and 18 as shown in FIG. 9 at (B) and (D), wherein the flapper 20 is closed.

The sheet 3 fed from the printer 2 in this process is conveyed in the path of the rollers 11 and 12, the flapper 20, the rollers 14 and 15, the tag affixing unit 16, and the rollers 17 and 18.

Figure 6:
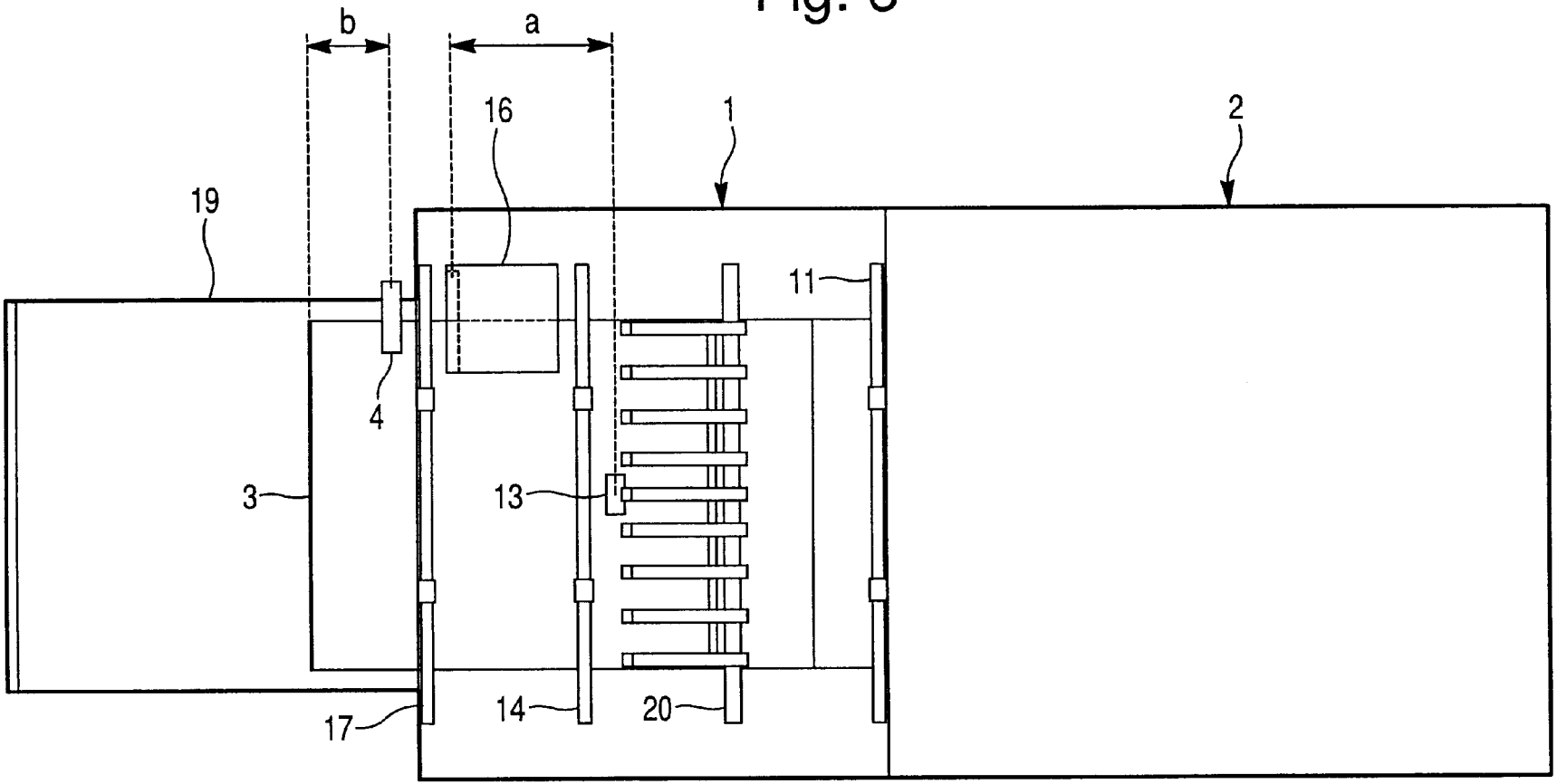
FIG. 6 is a front schematic view of the sheet sorting device when the tag is affixed to the sheet.

As a predetermined time period t2 elapses on the basis of the timing when the sensor 13 is turned ON by the sheet 3 conveyed by the rollers 14 and 15, the controller actuates the tag affixing unit 16 to affix the tag 4 to the predetermined position of the sheet 3 caught by the rollers 14 and 15 and the rollers 17 and 18 as shown in FIG. 6.

As a predetermined time period t3 elapses on the basis of the timing when the sensor 13 is turned ON by the sheet 3 conveyed by the rollers 14 and 15, the controller stops the rollers 11, 12, 14, 15, 17 and 18, and stops the tag affixing unit 16. Then, the sheet 3 printed on both surfaces of the sheet at a predetermined position thereof is affixed by the tag 4, and ejected on the tray 19.

Figure 10:
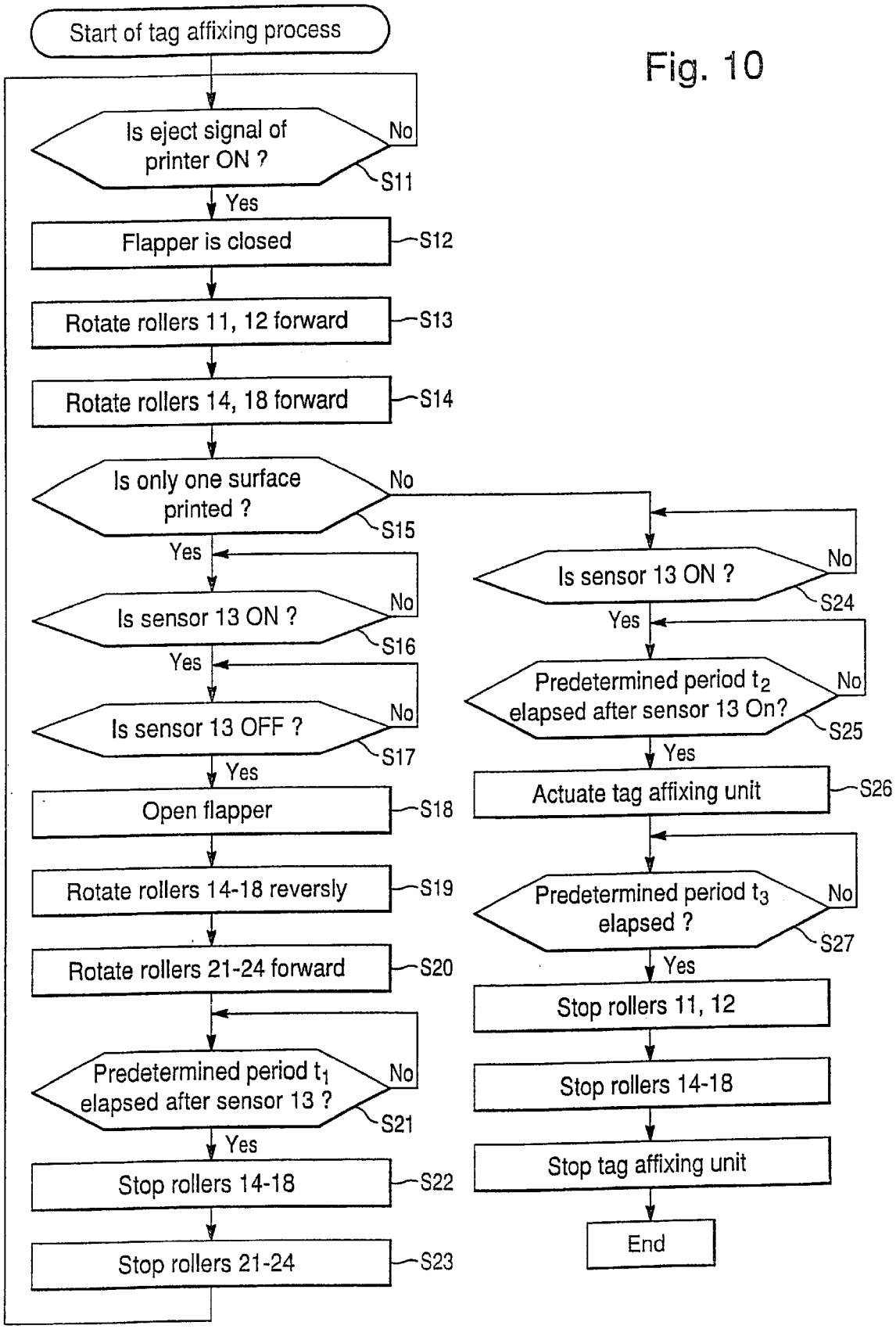
FIG. 10 shows a flow chart to explain an operation for affixing the tag on the sheet.

Next, returning to FIG. 10, there is shown a flow chart showing an operation of affixing the tag 4 to the sheet 3 printed on both surfaces of the sheet 3 in the sheet sorting device 1. Upon start of a tag affixing process, in a step S11, the controller of the sheet sorting device 1 inquires if the eject signal of the printer 2 is turned ON. If the eject signal of the printer 2 is confirmed to be turned ON, the sheet 3 is fed from the printer 2, and the sequence moves to a step S12 where the flapper 20 is closed. The controller of the sheet sorting device 1 rotates forward the rollers 11 and 12 in a step S13, and the rollers 14, 15, 17 and 18 in a step S14.

In a step S15, the controller of the sheet sorting device 1 inquires if only one surface of the sheet 3 fed from the printer 2 is printed. If it is confirmed that only one surface of the sheet 3 fed from the printer 2 is printed, the sequence moves to a step S16 to inquire if the sensor 13 is turned ON.

If it is confirmed in the step S16 that the sensor 13 remain OFF, the sheet 3 does not reach the position of the sensor 13, and the sequence returns to the step S16 on repeat until the sensor 13 is turned ON. If it is confirmed in the step S16 that the sensor 13 is turned ON, it is confirmed that the sheet 3 has reached the position of the sensor 13, and the sequence moves to a step S17 wherein the controller of the sheet sorting device 1 inquires if the sensor 13 is turned OFF.

If it is confirmed in the step S17 that the sensor 13 remains ON, the sequence returns to the step S17 on repeat until the sensor 13 is turned OFF. If it is confirmed in the step S17 that the sensor 13 is turned OFF, it is confirmed that the sheet 3 has passed over the position of the sensor 13, and the sequence moves to a step S18 wherein the controller of the sheet sorting device 1 opens the flapper 20. The controller of the sheet sorting device 1 rotates in reverse the rollers 14, 15, 17 and 18 in a step S19, and forward the rollers 21, 22, 23 and 24 in a step S20.

In a step S21, the controller of the sheet sorting device 1 inquires if a predetermined time period t1 elapses after the sensor 13 is turned OFF. If it is confirmed that a predetermined time period t1 has not yet elapsed after the sensor 13 is turned OFF, it is confirmed that the sheet 3 is not fed to the printer 2, and the sequence returns to the step S21 on repeat until the predetermined time period t1 elapses after the sensor 13 is turned OFF. If it is confirmed that a predetermined time period t1 has elapsed after the sensor 13 is turned OFF in the step S21, it is confirmed that the sheet 3 has been fed to the printer 2, and the sequence moves to the step S22 wherein the controller of the sheet sorting device 1 stops the rollers 14, 15, 17 and 18. In a step S23 the controller of the sheet sorting device 1 stops the rollers 21, 22, 23 and 24. The sequence returns to the step S11 to repeat the operation for detecting the eject signal.

If it is confirmed in the step S15 that both surfaces of the sheet 3 fed from the printer 2 are printed, the sequence moves to an inquire step S24 wherein the controller of the sheet sorting device 1 inquires if the sensor 13 is turned ON. If it is confirmed that the sensor 13 remains OFF, it is confirmed that the sheet 3 has not reached the position of the sensor 13, and the sequence returns to the step S24 to repeat the operation until the sensor 13 is turned ON.

If it is confirmed in the step S24 that the sensor 13 has been turned ON, it is confirmed that the sheet 3 has reached the position of the sensor 13. The sequence moves to an inquiry step S25 wherein the controller of the sheet sorting device 1 inquires if a predetermined time period t2 elapses after the sensor 13 is turned ON. If it is confirmed that the predetermined time period t2 has not yet elapsed after the sensor 13 is turned ON, the sequence returns to the step S25 on repeat until the predetermined time period t2 elapses after the sensor 13 is turned ON. If it is confirmed that the predetermined time period t2 has elapsed after the sensor 13 is turned ON in the step S25, it is confirmed that the sheet 3 has reached the predetermined position about the tag affixing unit 16, and the sequence moves to a step S26 wherein the controller of the sheet sorting device 1 actuates the tag affixing unit 16 to be applied to an inquiry step S27.

In the step S27, the controller of the sheet sorting device 1 inquires if a predetermined time period t3 elapses after the sensor 13 is turned ON. If it is confirmed that the predetermined time period t3 has not yet elapsed after the sensor 13 is turned ON, the sequence returns to the step S27 on repeat until the predetermined time period t3 elapses after the sensor 13 is turned ON because the sheet 3 is not yet ejected on the tray 19 completely. If it is confirmed that the predetermined time period t3 has elapsed after the sensor 13 is turned ON in the step S27, it is confirmed that the sheet 3 has been ejected on the tray 19 completely, and the sequence moves to a step S28 wherein the controller of the sheet sorting device 1 stops the rollers 11 and 12. Further the controller of the sheet sorting device 1 stops the rollers 14, 15, 17 and 18 in a step S29, and the tag affixing unit 16 in a step S30 to finish the sequence of the operation of FIG. 10.

Thus, the sheet sorting device 1 of this embodiment reverses the sheet 3 printed on one surface of the sheet by the printer to be fed back to the printer 2, whereby the tag 4 may be affixed on the predetermined position of the sheet 3 printed on both surfaces of the sheet. Though the image forming device is represented by the printer 2 in this embodiment, it may be replaced with a facsimile machine, a copy machine or the like if desired. According to this embodiment there is provided the sorting device 1 with a simple and small construction for reversing the sheet 3 fed from the printer 2 operating as an image forming device and adhering the tag on the sheet 3, which includes a conveying means (the rollers 14 and 15 in FIG. 1) for conveying the sheet 3 in a first or second direction (forward or backward direction), a detecting means (the sensor 13 in FIG. 1) for detecting a position of the sheet conveyed by the conveying means, a switching means (the flapper 20 in FIG. 1) for switching a path conveying the sheet based on a result of the detection by the detecting means, and a tag affixing means (the tag affixing unit 16 in FIG. 1) for passing the sheet when it is reversed and affixing the tag to the sheet when it is ejected, whereby the sheet may be reversed to be affixed by the tag, and easily and precisely sorted in reference to the affixed tag.

While this invention has been described and illustrated with respect to certain embodiments which give satisfactory results, it will be understood by those skilled in the art, after understanding the purpose of the invention, that various other changes and modifications may be made without departing from the spirit and scope of the invention, and it is therefore, intended in the appended claims to cover all such changes and modifications.

I claim:

1. A sorting device for reversing a sheet from a first surface to a second surface fed from an image forming device and adhering a tag on the sheet, comprising:

a conveyor for conveying said sheet in at least a first or a second direction;

a detector for detecting a position of said sheet conveyed by said conveyor;

a switch for switching a path conveying said sheet based on a result of the detection by said detector;

a tag affixing device for passing said sheet when it is reversed and affixing a tag to said sheet when it is ejected; and a controller commanding said tag affixing device to pass said sheet.

2. A sorting device according to claim 1, further comprising a controller for controlling a time period from a time point when said detector detects the position of said sheet to a time point when said tag affixing device affixes said tag on said sheet.

3. An image forming device having a sorting device for reversing a sheet from a first surface to a second surface fed from said image forming device and affixing a tag to the sheet, said sorting device comprising:

a conveyor for conveying said sheet;

a detector for detecting a position of said sheet conveyed by said conveyor;

a switch for switching a path conveying said sheet based on a result of the detection by said detector;

a tag affixing device for passing said sheet when it is reversed and affixing a tag to said sheet when it is ejected; and a controller commanding said tag affixing device to pass said sheet.

4. A sorting device according to claim 3, wherein said conveyor conveys said sheet in at least a first or a second direction and said switch changes the direction of conveying.

5. An image forming device according to claim 3, wherein said image forming device is a printer.

6. A sorting device for reversing a sheet from a first surface to a second surface fed from an image forming device and adhering a tag on the sheet, comprising:

a conveying roller for conveying said sheet in a first or a second direction;

a sensor for detecting a position of said sheet conveyed by said conveying roller;

a flapper for switching a path conveying said sheet based on a result of the detection by said sensor;

a tag affixing device for passing said sheet when it is reversed and affixing a tag to said sheet when it is ejected; and a controller commanding said tag affixing device to pass said sheet.

7. A sorting device according to claim 6, wherein said switch changes the direction of conveying by said conveying roller.

* * * * *